US009305487B2

(12) United States Patent
Yang et al.

(10) Patent No.: US 9,305,487 B2
(45) Date of Patent: Apr. 5, 2016

(54) ORGANIC LIGHT EMITTING DIODE DISPLAY AND METHOD FOR DRIVING DISPLAY PANEL THEREOF

(75) Inventors: Hsueh-Yen Yang, Taoyuan County (TW); Tze-Chien Tsai, Taipei County (TW)

(73) Assignee: Au Optronics Corporation, Hsinchu (TW)

( * ) Notice: Subject to any disclaimer, the term of this patent is extended or adjusted under 35 U.S.C. 154(b) by 696 days.

(21) Appl. No.: 13/304,694

(22) Filed: Nov. 28, 2011

(65) Prior Publication Data

US 2012/0139965 A1 Jun. 7, 2012

(30) Foreign Application Priority Data

Dec. 6, 2010 (TW) ..... 99142391 A

(51) Int. Cl.

| | |
|---|---|
| ***G09G 3/32*** | (2006.01) |
| ***G09G 5/02*** | (2006.01) |
| *G09G 3/36* | (2006.01) |

(52) U.S. Cl.

CPC ..... *G09G 3/3225* (2013.01); *G09G 5/026* (2013.01); *G09G 3/3208* (2013.01); *G09G 3/3611* (2013.01); *G09G 2300/0452* (2013.01); *G09G 2340/0457* (2013.01)

(58) Field of Classification Search

None

See application file for complete search history.

(56) References Cited

U.S. PATENT DOCUMENTS

| | | | | |
|---|---|---|---|---|
| 6,867,549 | B2 | 3/2005 | Cok et al. | |
| 6,933,534 | B1 * | 8/2005 | Steffensmeier | 257/89 |
| 7,158,148 | B2 | 1/2007 | Toji et al. | |
| 7,215,347 | B2 * | 5/2007 | Phan | 345/694 |
| 7,319,471 | B2 * | 1/2008 | Natori et al. | 345/690 |
| 2002/0063710 | A1 * | 5/2002 | Hirota et al. | 345/428 |
| 2003/0020729 | A1 * | 1/2003 | Toji et al. | 345/613 |
| 2005/0185003 | A1 | 8/2005 | Dedene et al. | |
| 2005/0225548 | A1 * | 10/2005 | Han et al. | 345/213 |
| 2006/0033422 | A1 * | 2/2006 | Chao et al. | 313/500 |
| 2007/0182687 | A1 * | 8/2007 | Kim et al. | 345/98 |
| 2008/0224968 | A1 * | 9/2008 | Kashiwabara | 345/83 |
| 2008/0303766 | A1 * | 12/2008 | Lee et al. | 345/89 |
| 2010/0141693 | A1 * | 6/2010 | Lee et al. | 345/694 |

FOREIGN PATENT DOCUMENTS

| | | | |
|---|---|---|---|
| CN | 1399243 | A | 2/2003 |
| CN | 101191914 | A | 6/2008 |
| CN | 101216649 | A | 7/2008 |
| TW | 200627364 | | 8/2006 |

* cited by examiner

*Primary Examiner* — Seokyun Moon

(74) *Attorney, Agent, or Firm* — Jianq Chyun IP Office

(57) ABSTRACT

An OLED display and a method for driving a display panel thereof are provided. The layout area of each pixel of the OLED display panel is specially designed to be a rectangle in shape, and the pixels are driven in such a manner that each two sub-pixels are taken as a unit to be driven. As such, according to the interaction manner among sub-pixels of the pixels, two sub-pixels can be viewed as one pixel to achieve more pixels within 1 inch in comparison with the conventional panels, which enables the current AMOLED driving circuit designs to be used in specific high resolution applications.

21 Claims, 8 Drawing Sheets

ORGANIC LIGHT EMITTING DIODE DISPLAY AND METHOD FOR DRIVING DISPLAY PANEL THEREOF

CROSS-REFERENCE TO RELATED APPLICATION

This application claims the priority benefit of Taiwan application serial no. 99142391, filed on Dec. 6, 2010. The entirety of the above-mentioned patent application is hereby incorporated by reference herein and made a part of this specification.

BACKGROUND OF THE INVENTION

1. Technical Field

The present invention relates to flat display technology, and more particularly, to an organic light emitting diode display and a method for driving a display panel thereof.

2. Description of Related Art

Following the rapid advancement in the multimedia society, great progresses have been made on semiconductor elements and display technology. With respect to displays, active matrix organic light emitting diode (AMOLED) displays satisfy the performance requirements by displays in the multimedia era because of the advantages of no view angle limitation, low manufacturing cost, high response speed, less power consumption, self-illumination, direct current driving for use with portable devices, large operation temperature range, light weight, and the capabilities of being made smaller and thinner. As such, the AMOLED displays have great development potential and are expected to the next generation flat panel display replacing liquid crystal displays (LCD).

In general, current AMOLED driving circuit designs mostly use more than two thin film transistors (TFTs) in combination with one storage capacitor (Cst) to drive a single OLED. The TFT layout area constrains the minimum layout area of each pixel in the OLED display panel, which makes it impossible to achieve high resolution of OLED display panel in portable electronic devices having a small-sized panel, such as, cell phones, PDA, or the like.

SUMMARY OF DISCLOSURE

Accordingly, the disclosure is directed to an OLED display panel and a driving method for the display panel which enables current AMOLED driving circuit design to be used in specific high resolution applications.

An OLED display is provided which includes an OLED display and a driving device. The OLED display panel includes a plurality of pixels arranged in array. The layout area of each pixel is substantially a rectangle in shape. Each pixel includes a plurality of sub-pixels. The driving device is coupled to the OLED display panel to drive the pixels in such a manner that each two sub-pixels are taken as a pixel unit to be driven, according to data signals of three rows of sub-pixels.

A driving method for an OLED display panel is also provided. The OLED display panel includes a plurality of pixels arranged in array. The layout area of each pixel is substantially a rectangle in shape. Each pixel includes a plurality of sub-pixels. The driving method includes: performing an analysis of point, line and plane on each 3*3 pixel array according to data signals of three rows of sub-pixels; and driving all the pixels of the organic light emitting diode display panel in such a manner that each two sub-pixels are taken as a pixel unit to be driven, according to the relationship between a center pixel of each 3*3 pixel array and pixels around the center pixel.

In view of the foregoing, the layout area of each pixel of the OLED display panel is specially designed to be a rectangle in shape, and the pixels are driven in such a manner that each two sub-pixels are taken as a unit to be driven. As such, according to the interaction manner among sub-pixels of the pixels, two sub-pixels can be viewed as one pixel to achieve more pixels within 1 inch in comparison with the conventional panels, which enables the current AMOLED driving circuit designs to be used in specific high resolution applications.

Other objectives, features and advantages of the disclosure will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the disclosure, and are incorporated in and constitute a part of this specification. The drawings illustrate embodiments of the invention and, together with the description, serve to explain the principles of the invention.

DESCRIPTION OF THE EMBODIMENTS

Figure 1:
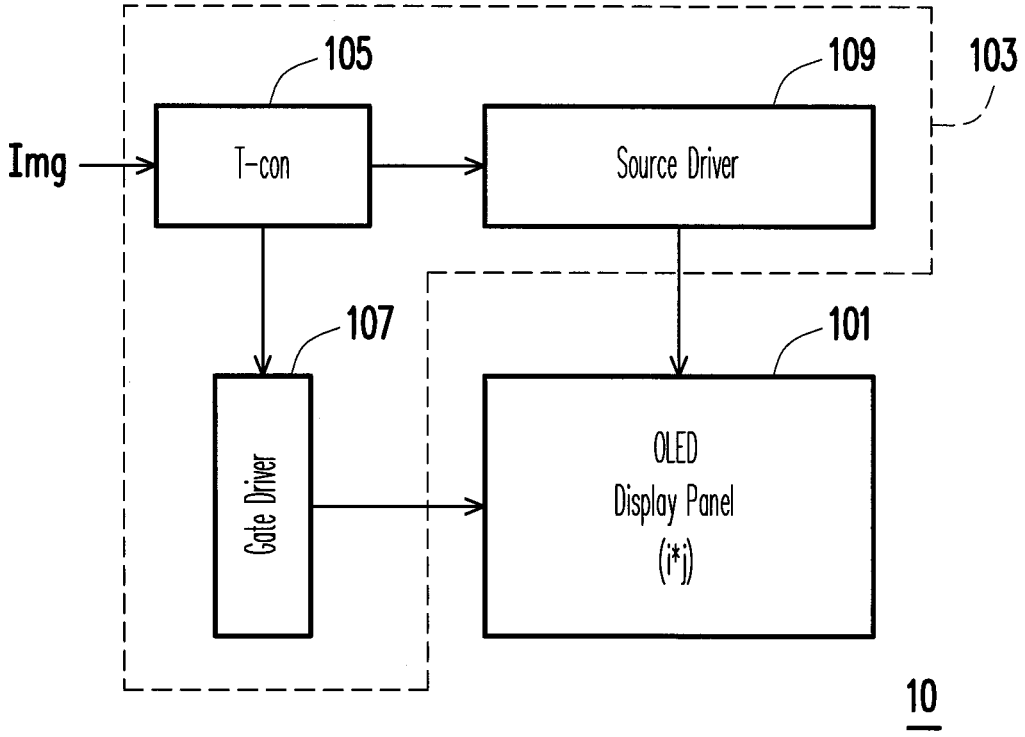
FIG. 1 is a system block diagram of an active matrix organic light emitting diode (AMOLED) display according to one embodiment of the present invention.

Reference will now be made in detail to the embodiments of the disclosure, examples of which are illustrated in the accompanying drawings. Wherever possible, the same reference numbers are used in the drawings and the description to refer to the same or like parts.

FIG. 1 is a system block diagram of an active matrix organic light emitting diode (AMOLED) display 10 according to one embodiment. Referring to FIG. 1, the AMOLED display 10 includes an OLED display panel 101 and a driving device 103. The OLED display panel 101 includes a plurality of pixels arranged in i*j array. Each pixel is substantially a rectangle in shape and includes a plurality of sub-pixels.

It is noted that the horizontal length (L) of each sub-pixel of the embodiment is longer than that of conventional sub-pixel (the ratio of the present embodiment's length to the conventional length may be, but not limited to, 1.5), and the vertical width (W) of each sub-pixel of the embodiment may be the same as that of the conventional vertical width, as illustrated in FIG. 2A to FIG. 2G. Thus, in a layout area of one pixel, the same as a layout area of a conventional pixel including three sub-pixels, one pixel of the embodiment includes two sub-pixels. It is noted, however, this particular embodiment is merely illustrative rather than limiting.

In addition, the driving device 103 may include a timing controller (T-con) 105, a gate driver 107, and a source driver 109. The driving device 103 is coupled to the OLED display panel 101 for driving all the pixels of the OLED display panel 101 in such a manner that each pixel unit with two sub-pixels is driven according to data signals of three rows of color sub-pixels.

In the embodiment, the T-con 105 controls the operations of the gate driver 107 and the source driver 109 in response to the inputted serial image signals Img, thereby enabling the gate driver 107 and source driver 109 to coordinate with each other to output scan signals and data signals (i.e. driving currents) to drive pixels of the OLED display panel 101, respectively, such that the OLED display panel 101 can display images to users.

To this end, current AMOLED driving circuit designs mostly use more than two thin film transistors (TFT) in combination with one storage capacitor (Cst) to drive a single OLED. The TFT layout area affects the minimum layout area of each sub-pixel in the OLED display panel, which makes it impossible to achieve high resolution of OLED display panel in portable electronic devices having a small-sized panel, such as, cell phones, PDA, or the like.

Figure 2A:
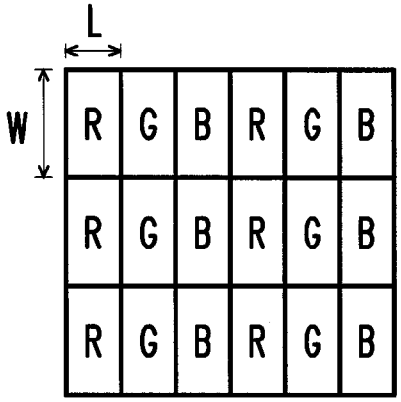
FIG. 2A to FIG. 2G each is an arrangement of the pixels of the OLED display panel according to one embodiment of the present invention.
Figure 2B:
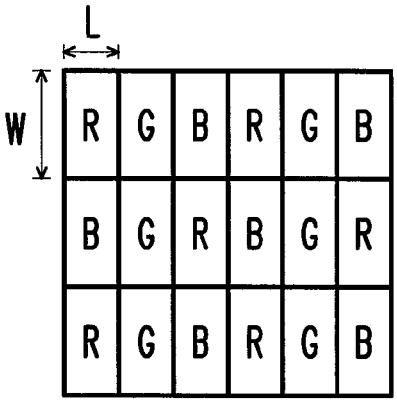
Figure 2C:
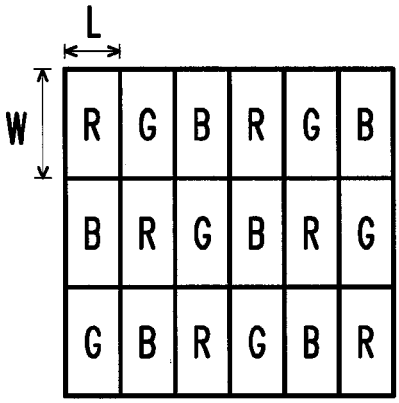
Figure 2D:
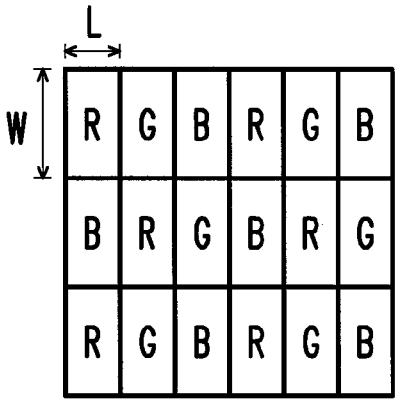
Figure 2E:
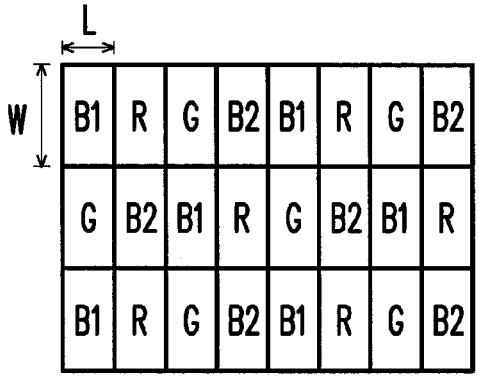
Figure 2F:
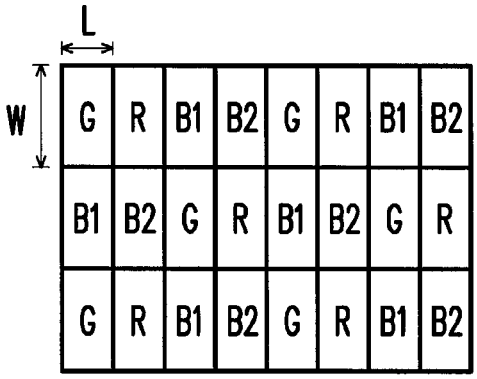
Figure 2G:
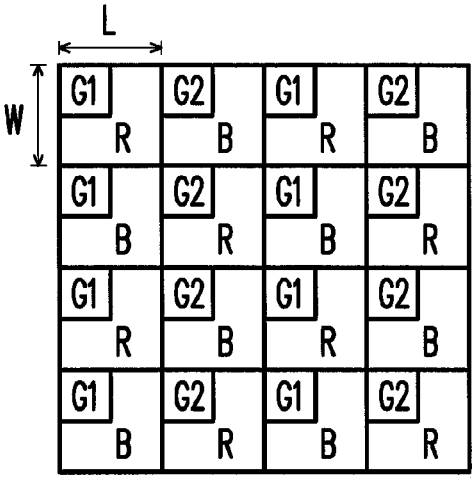

In view of the problem described above, in order for the current AMOLED driving circuit designs to be used for specific high resolution applications, in the present embodiment, the pixel array of the OLED display panel 101 includes three color sub-pixels including, a red (R, made of red material), a green (G, made of green material) and a blue (B, made of blue material) sub-pixels, as shown in FIG. 2A to FIG. 2D; or, the pixel array includes four color sub-pixels including, a red (R), a green (G), a dark blue (B2, made of blue material) and a light blue (B1, made of cyan material) sub-pixels, as shown in FIG. 2E to FIG. 2F; or, the pixel array includes four color sub-pixels including, a red (R), a first green (G1, made of green material), a second green (G2, made of green material) and a blue (B) sub-pixels, as shown in FIG. 2G.

More specifically, as shown in FIG. 2A, the three color sub-pixels in the $i^{th}$ row of pixels of the OLED display panel 101 are arranged in order of red (R)-green (G)-blue (B), where i is a positive integer. As shown in FIG. 2B, the three color sub-pixels in the $i^{th}$ row of pixels of the OLED display panel 101 are arranged in order of red (R)-green (G)-blue (B), where i is an odd positive integer; and the three color sub-pixels in the $(i+1)^{th}$ row of pixels of the OLED display panel 101 are arranged in order of blue (B)-green (G)-red (R).

As shown in FIG. 2C, the three color sub-pixels in the $(3i+1)^{th}$ row of pixels of the OLED display panel 101 are arranged in order of red (R)-green (G)-blue (B), where i is zero or a positive integer; the three color sub-pixels in the $(3i+2)^{th}$ row of pixels of the OLED display panel 101 are arranged in order of blue (B)-red (R)-green (G); and the three color sub-pixels in the $(3i+3)^{th}$ row of pixels of the OLED display panel 101 are arranged in order of green (G)-blue (B)-red (R).

As shown in FIG. 2D, the three color sub-pixels in the $i^{th}$ row of pixels of the OLED display panel 101 are arranged in order of red (R)-green (G)-blue (B), where i is an odd positive integer; and the three color sub-pixels in the $(i+1)^{th}$ row of pixels of the OLED display panel 101 are arranged in order of blue (B)-red (R)-green (G).

As shown in FIG. 2E, the four color sub-pixels in the $i^{th}$ row of pixels of the OLED display panel 101 are arranged in order of light blue (B1)-red (R)-green (G)-dark blue (B2), where i is an odd positive integer; and the four color sub-pixels in the $(i+1)^{th}$ row of pixels of the OLED display panel 101 are arranged in order of green (G)-dark blue (B2)-light blue (B1)-red (R).

As shown in FIG. 2F, the four color sub-pixels in the $i^{th}$ row of pixels of the OLED display panel 101 are arranged in order of green (G)-red (R)-light blue (B1)-dark blue (B2), where i is an odd positive integer; and the four color sub-pixels in the $(i+1)^{th}$ row of pixels of the OLED display panel 101 are arranged in order of light blue (B1)-dark blue (B2)-green (G)-red (R).

As shown in FIG. 2G, the four color sub-pixels of each pixel in the $i^{th}$ row of pixels of the OLED display panel 101 are arranged in order of first green (G1)-red (R)-second green (G2)-blue (B), where i is an odd positive integer, the red (R) sub-pixel is L-shaped which partly encloses the first green (G1) sub-pixel, and the blue (B) sub-pixel is also L-shaped which partly encloses the second green (G2) sub-pixel. In addition, the four color sub-pixels in the $(i+1)^{th}$ row of pixels of the OLED display panel 101 are arranged in order of first green (G1)-blue (B)-second green (G2)-red (R), the blue (B) sub-pixel is L-shaped which partly encloses the first green (G1) sub-pixel, and the red (R) sub-pixel is also L-shaped which partly encloses the second green (G2) sub-pixel.

From the above, the driving device 103 can temporarily store the inputted serial image signals Img in, for example, a line buffer or frame buffer embedded in the T-con 105, and then an analysis of point, line and plane is performed on each 3*3 pixel array. As such, the driving device 103 can drive all the pixels of the OLED display panel 101 in such a manner that each pixel unit with two sub-pixels is driven, according to the relationship between a center pixel of each 3*3 pixel array and pixels around the center pixel.

Figure 3A:
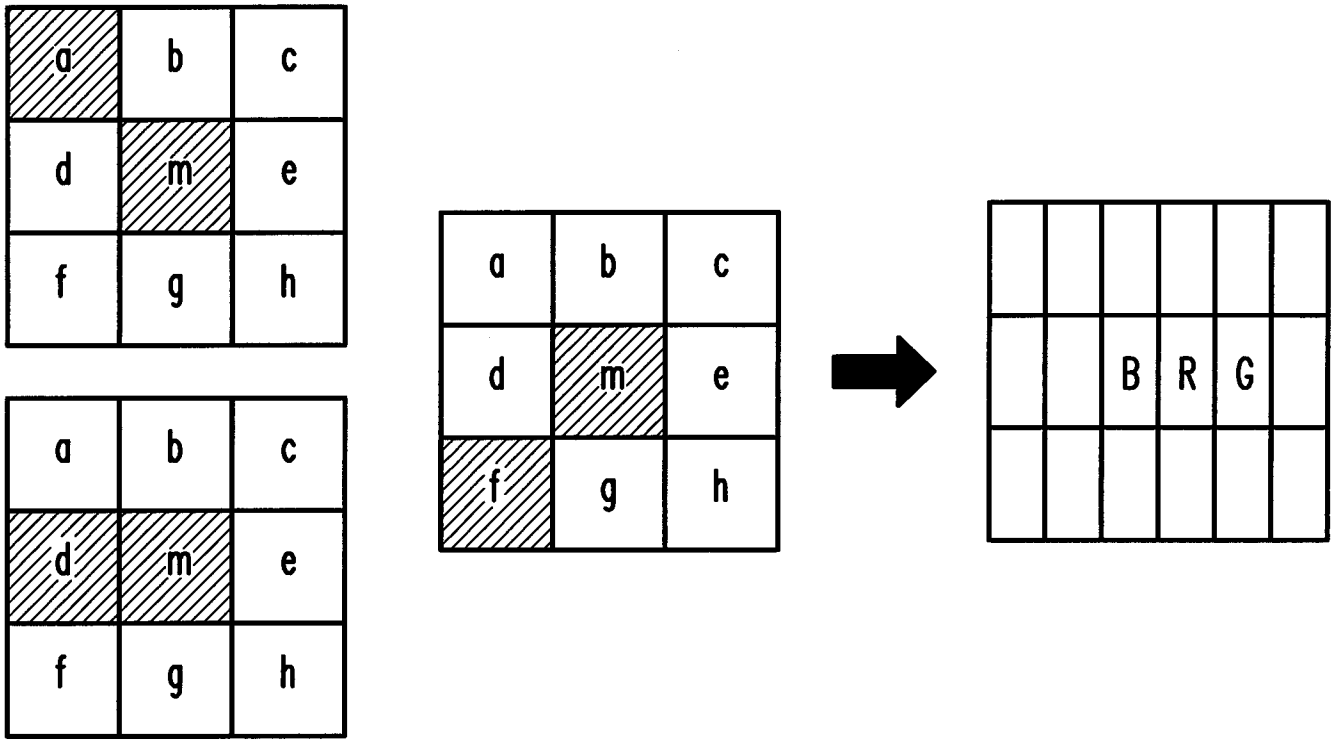
FIG. 3A to FIG. 3D each is a driving scheme of the pixels of the OLED display panel according to one embodiment of the present invention.

More specifically, the nine pixels in each 3*3 pixel array are denoted by a to h and m (e.g. as shown in FIG. 3A to FIG. 3D), and the center pixel m consisting of the adjacent blue (B) and red (R) sub-pixels of FIG. 2A is to be driven or for displaying signals. When the center pixel m and a left upper pixel a have a connection, or the center pixel m and a left pixel d have the connection, or the center pixel m and a left lower pixel f have the connection, and the center pixel m has no connection with the remaining pixels, then the driving device 103 can correspondingly drive the blue (B) and the red (R) sub-pixels of the (x, y) pixel (the center pixel) and green (G) sub-pixel of the (x+1, y) pixel adjacent the (x, y) pixel for color mixing, where x represents a position in row, y represents a position in column, as shown in FIG. 3A. It is noted that the connection between the pixels mentioned above means that brightness/luminance of the pixels has the similarity. To be specific, if the luminance difference between the pixels is within a predetermined range, for example, 16 gray-level, but not limited thereto, it thus means that the brightness/luminance of the pixels has the similarity.

Figure 3B:
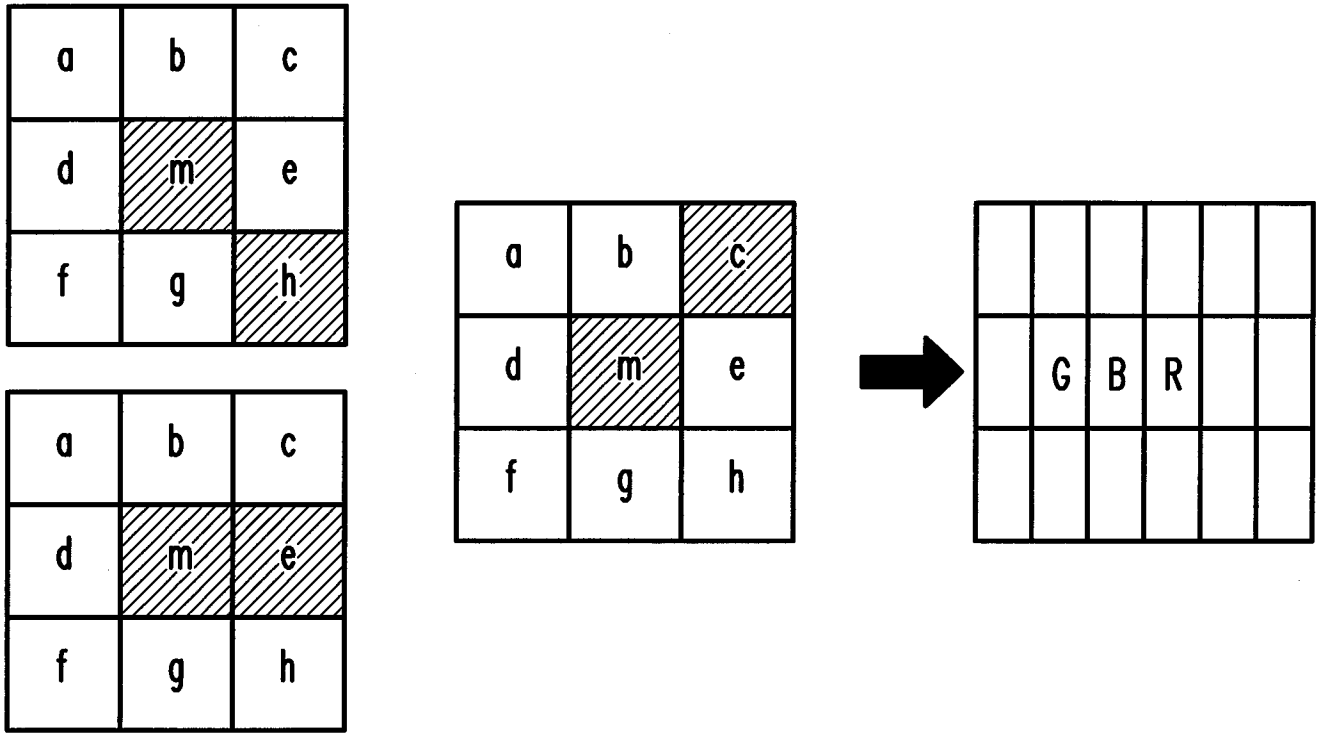

In addition, when the center pixel m and a right lower pixel h have the connection, or the center pixel m and a right pixel e have the connection, or the center pixel m and a right upper pixel c have the connection, and the center pixel m has no connection with the remaining pixels, then the driving device 103 can correspondingly drive the blue (B) and red (R) sub-pixels of the (x, y) pixel (the center pixel) and the green (G) sub-pixel of the (x−1, y) pixel adjacent the (x, y) pixel for color mixing, as shown in FIG. 3B.

Figure 3C:
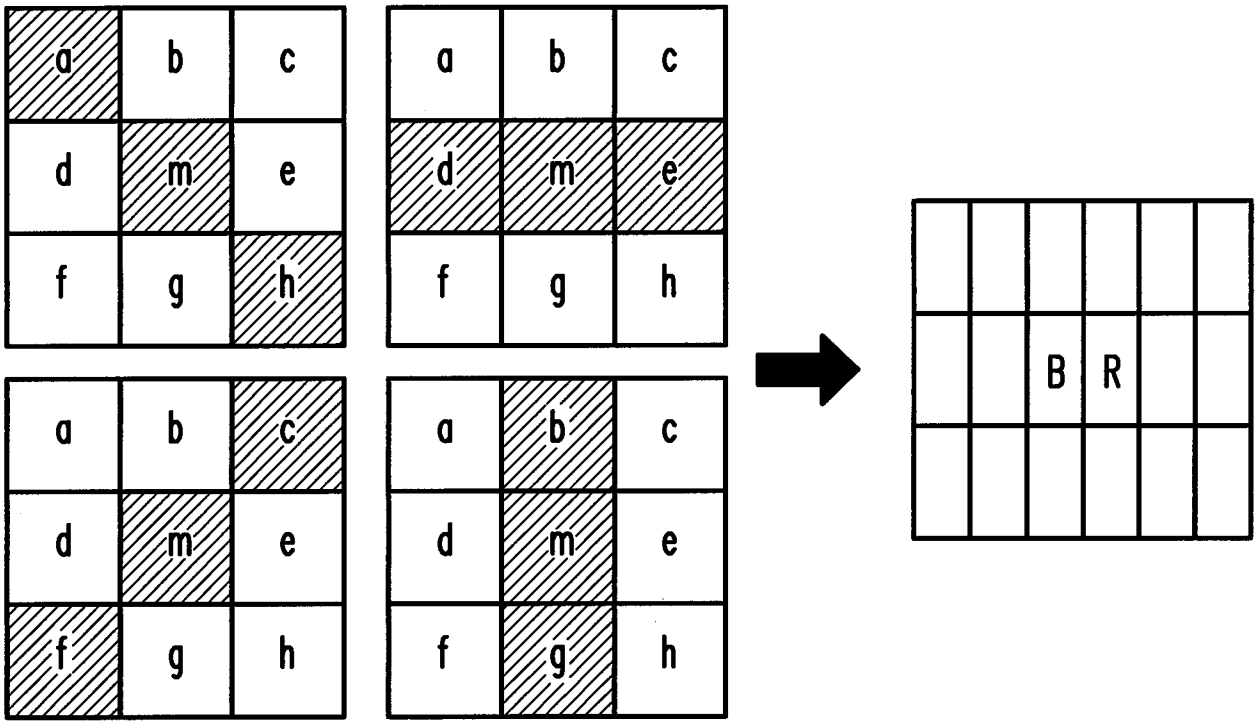

Moreover, when the center pixel m has the connection with both left upper and right lower pixels (a, h), or the center pixel m has the connection with both right upper and left lower pixels (c, f), or the center pixel m has the connection with both right and left pixels (d, e), or the center pixel m has the connection with both upper and lower pixels (b, g), and the center pixel m has no connection with the remaining pixels, then the driving device 103 can correspondingly drive the blue (B) and the red (R) sub-pixels of the (x, y) pixel without combining with sub-pixel of the adjacent pixel for color mixing, as shown in FIG. 3C.

Figure 3D:
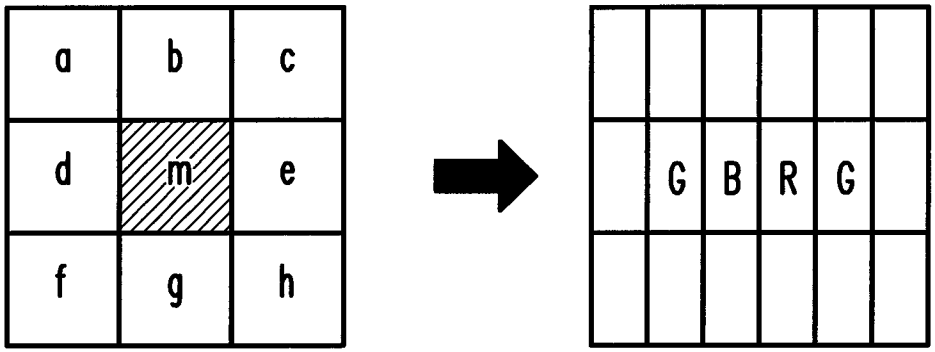

Besides, when the center pixel m has no connection with any pixel (a to f) around thereof, then the driving device 103 can correspondingly drive the blue (B) and red (R) sub-pixels of the (x, y) pixel, the green (G) sub-pixels of the (x−1, y) pixel adjacent the (x, y) pixel and the green (G) sub-pixel of the (x+1, y) pixel adjacent the (x, y) pixel for color mixing, as shown in FIG. 3D.

Similarly, the driving device 103 may also determine the driving manner of adjacent two sub-pixels in FIG. 2A to FIG. 2G in the manner similar to that described with reference to FIG. 3A to FIG. 3D and, therefore, explanation thereof is not repeated herein. It can thus be seen that the driving device 103 drives the pixels in such a manner that each two sub-pixels are taken as a pixel unit to be driven. As such, according to the interaction manner among sub-pixels of the pixels (R/G/B, R/G/B1/B2, R/G1/G2/B), two sub-pixels can be viewed as one pixel to achieve more pixels within a unit area in comparison with the conventional panels, which enables the current AMOLED driving circuit designs to be used in specific high resolution applications.

Figure 4:
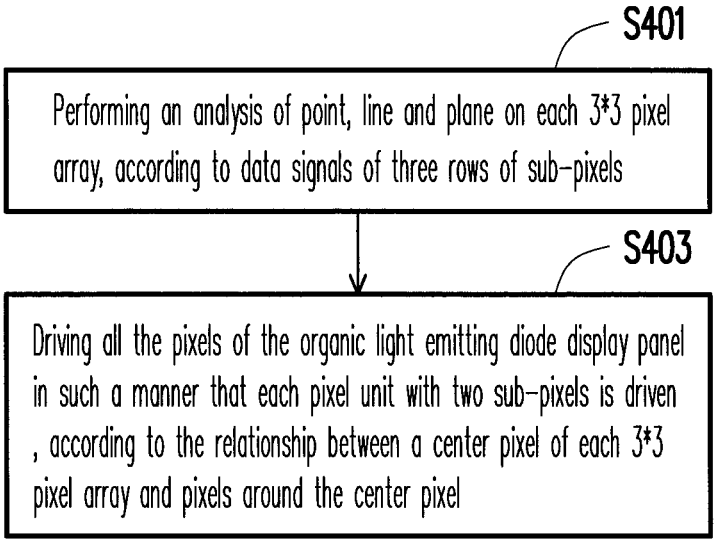
FIG. 4 is a flow chart of a driving method for the OLED display panel according to one embodiment.

Base on the description/teaching of the above embodiments, FIG. 4 is a flow chart of the driving method of the OLED display panel according to one embodiment of the present invention. Referring to FIG. 4, the driving method of the present embodiment is adapted to an OLED display panel that has a plurality of pixels arranged in array and in which layout area of each pixel is substantially a rectangle in shape, and each pixel includes a plurality of sub-pixels. The driving method includes: performing an analysis of point, line and plane on each 3*3 pixel array according to data signals of three rows of sub-pixels (step S401); and driving all the pixels of the OLED display panel in such a manner that each pixel unit with two sub-pixels is driven, according to the relationship between the center pixel of each 3*3 pixel array and pixels around the center pixel (step S403). In the present embodiment, the relationship mentioned in step S403 may include the examples shown in FIG. 3A to FIG. 3D, but may also be modified in another embodiment depending upon actual requirements.

In summary, in the present invention, the layout area of each pixel of the OLED display panel is specially designed to be a rectangle in shape, and the pixels are driven in such a manner that each two sub-pixels are taken as a pixel unit to be driven. As such, according to the interaction manner among sub-pixels of the pixels, two sub-pixels can be viewed as one pixel to achieve more pixels within a unit area in comparison with the conventional panels, which enables the current AMOLED driving circuit designs to be used in specific high resolution applications.

It will be apparent to those skilled in the art that the descriptions above are several preferred embodiments of the invention only, which does not limit the implementing range of the invention. Various modifications and variations can be made to the structure of the invention without departing from the scope or spirit of the invention. The claim scope of the invention is defined by the claims hereinafter. In addition, any one of the embodiments or claims of the invention is not necessarily achieve all of the above-mentioned objectives, advantages or features. The abstract and the title herein are used to assist searching the documentations of the relevant patents, not to limit the claim scope of the invention.

What is claimed is:

1. An organic light emitting diode display comprising:

an organic light emitting diode display panel comprising a plurality of pixels arranged in array, each pixel comprising a plurality of sub-pixels, wherein each of the sub-pixels is merely used for displaying a single color; and a driving device coupled to the organic light emitting diode display panel to drive each of the pixels in a manner that at least one sub-pixel adjacent to the pixel and the pixel are driven for color mixing according to data signals of at least one pixel within at most three rows, wherein the driving device drives the at least one sub-pixel adjacent to the pixel and the pixel for color mixing in response to determining that a luminance difference between the data signals of each of the pixels and the data signals of each of the adjacent pixels is within a predetermined range.

2. The organic light emitting diode display according to claim 1, wherein the sub-pixels include red, green and blue sub-pixels.

3. The organic light emitting diode display according to claim 2, wherein the sub-pixels of the $i^{th}$ row of pixels of the organic light emitting device display panel are arranged in order of red-green-blue, where i is a positive integer.

4. The organic light emitting diode display according to claim 2, wherein the sub-pixels of the $i^{th}$ row of pixels of the organic light emitting device display panel are arranged in order of red-green-blue, where i is an odd positive integer; and the sub-pixels of the $(i+1)^{th}$ row of pixels of the organic light emitting device display panel are arranged in order of blue-green-red.

5. The organic light emitting diode display according to claim 2, wherein the sub-pixels of the $(3i+1)^{th}$ row of pixels of the organic light emitting device display panel are arranged in order of red-green-blue, where i is zero or a positive integer;

the sub-pixels of the $(3i+2)^{th}$ row of pixels of the organic light emitting device display panel are arranged in order of blue-red-green; and the sub-pixels of the $(3i+3)^{th}$ row of pixels of the organic light emitting device display panel are arranged in order of green-blue-red.

6. The organic light emitting diode display according to claim 2, wherein the sub-pixels of the $i^{th}$ row of pixels of the organic light emitting device display panel are arranged in order of red-green-blue, where i is an odd positive integer; and the sub-pixels of the $(i+1)^{th}$ row of pixels of the organic light emitting device display panel are arranged in order of blue-red-green.

7. The organic light emitting diode display according to claim 1, wherein the sub-pixels include red, green, dark blue and light blue sub-pixels.

8. The organic light emitting diode display according to claim 7, wherein the sub-pixels of the $i^{th}$ row of pixels of the organic light emitting device display panel are arranged in order of light blue-red-green-dark blue, where i is an odd positive integer; and the sub-pixels of the $(i+1)^{th}$ row of pixels of the organic light emitting device display panel are arranged in order of green-dark blue-light blue-red.

9. The organic light emitting diode display according to claim 7, wherein the sub-pixels of the $i^{th}$ row of pixels of the organic light emitting device display panel are arranged in order of green-red-light blue-dark blue, where i is an odd positive integer; and the sub-pixels of the $(i+1)^{th}$ row of pixels of the organic light emitting device display panel are arranged in order of light blue-dark blue-green-red.

10. The organic light emitting diode display according to claim 1, wherein the sub-pixels include red, first green, second green, and blue sub-pixels.

11. The organic light emitting diode display according to claim 10, wherein the sub-pixels of the $i^{th}$ row of pixels of the organic light emitting device display panel are arranged in order of first green-red-second green-blue, where i is an odd positive integer, the red sub-pixel is L-shaped which partly encloses the first green sub-pixel, and the blue sub-pixel is L-shaped which partly encloses the second green sub-pixel; and the sub-pixels of the $(i+1)^{th}$ row of pixels of the organic light emitting device display panel are arranged in order of first green-blue-second green-red, the blue sub-pixel is L-shaped which partly encloses the first green sub-pixel, and the red sub-pixel is L-shaped which partly encloses the second green sub-pixel.

12. The organic light emitting diode display according to claim 1, wherein each 3*3 pixel array of the pixels are taken as a unit, and the driving device drives the at least one sub-pixel adjacent to the pixel and the pixel for color mixing according to a relationship between the data signals of a center pixel of each 3*3 pixel array and the data signals of the adjacent pixels of each 3*3 pixel array around the center pixel.

13. The organic light emitting diode display according to claim 12, wherein when the relationship comprises that the center pixel and a left upper pixel have connection, or the center pixel and a left pixel have connection, or the center pixel and a left lower pixel have connection, and the center pixel has no connection with the remaining pixels, then the driving device correspondingly drives two sub-pixel of the center (x, y) pixel and one sub-pixel of the (x+1, y) pixel adjacent the (x, y) pixel for color mixing, where x represents a position in row, y represents a position in column, wherein the connection means that the luminance of the data signals of each of the pixels and the data signals of each of the adjacent pixels has the similarity when the luminance difference between the data signals of each of the pixels and the data signals of each of the adjacent pixels is within the predetermined range.

14. The organic light emitting diode display according to claim 12, wherein when the relationship comprises that the center pixel and a right lower pixel have connection, or the center pixel and a right pixel have connection, or the center pixel and a right upper pixel have connection, and the center pixel has no connection with the remaining pixels, then the driving device correspondingly drives two sub-pixels of the center (x, y) pixel and one sub-pixel of the (x−1, y) pixel adjacent the (x, y) pixel for color mixing, where x represents a position in row, y represents a position in column, wherein the connection means that the luminance of the data signals of each of the pixels and the data signals of each of the adjacent pixels has the similarity when the luminance difference between the data signals of each of the pixels and the data signals of each of the adjacent pixels is within the predetermined range.

15. The organic light emitting diode display according to claim 12, wherein when the relationship comprises that the center pixel has connection with both left upper and right lower pixels, or the center pixel has connection with both right upper and left lower pixels, or the center pixel has connection with both right and left pixels, or the center pixel has connection with both upper and lower pixels, and the center pixel has no connection with the remaining pixels, then the driving device correspondingly drives two sub-pixels of the center (x, y) pixel without combining with sub-pixel of the adjacent pixel for color mixing, where x represents a position in row, y represents a position in column, wherein the connection means that the luminance of the data signals of each of the pixels and the data signals of each of the adjacent pixels has the similarity when the luminance difference between the data signals of each of the pixels and the data signals of each of the adjacent pixels is within the predeteimined range.

16. The organic light emitting diode display according to claim 12, wherein when the relationship comprises that the center pixel has no connection with any adjacent pixel around thereof, then the driving device correspondingly drives two sub-pixels of the center (x, y) pixel, one sub-pixel of the (x+1, y) pixel adjacent the (x, y) pixel, and one sub-pixel of the (x−1, y) pixel adjacent the (x, y) pixel for color mixing, where x represents a position in row, y represents a position in column, wherein the connection means that the luminance of the data signals of each of the pixels and the data signals of each of the adjacent pixels has the similarity when the luminance difference between the data signals of each of the pixels and the data signals of each of the adjacent pixels is within the predetermined range.

17. A driving method for an organic light emitting diode display panel, wherein the organic light emitting diode display panel comprises a plurality of pixels arranged in array, each pixel comprises a plurality of sub-pixels, each of the sub-pixels is merely used for displaying a single color, and the driving method comprises:

performing an analysis of point, line and plane on each 3*3 pixel array according to data signals of at least one pixel within at most three rows of each 3*3 pixel array; and driving each of the pixels of the organic light emitting diode display panel in a manner that at least one sub-pixel adjacent to the pixel and the pixel are driven for color mixing in response to determining that a luminance difference between the data signals of a center pixel of each 3*3 pixel array and the data signals of a plurality of adjacent pixels of each 3*3 pixel array around the center pixel is within a predetermined range.

18. The driving method according to claim 17, wherein when a relationship between the data signals of the center pixel of each 3*3 pixel array and the data signals of the adjacent pixels of each 3*3 pixel array around the center pixel comprises that the center pixel and a left upper pixel have connection, or the center pixel and a left pixel have connection, or the center pixel and a left lower pixel have connection, and the center pixel has no connection with the remaining pixels, then the driving device correspondingly drives two sub-pixel of the center (x, y) pixel and one sub-pixel of the (x+1, y) pixel adjacent the (x, y) pixel for color mixing, where x represents a position in row, y represents a position in column, wherein the connection means that the luminance of the data signals of each of the pixels and the data signals of each of the adjacent pixels has the similarity when the luminance difference between the data signals of each of the pixels and the data signals of each of the adjacent pixels is within the predetermined range.

19. The driving method according to claim 17, wherein when a relationship between the data signals of the center pixel of each 3*3 pixel array and the data signals of the adjacent pixels of each 3*3 pixel array around the center pixel comprises that the center pixel and a right lower pixel have connection, or the center pixel and a right pixel have connection, or the center pixel and a right upper pixel have connection, and the center pixel has no connection with the remaining pixels, then the driving device correspondingly drives two sub-pixels of the center (x, y) pixel and one sub-pixel of the (x−1, y) pixel adjacent the (x, y) pixel for color mixing, where x represents a position in row, y represents a position in column, wherein the connection means that the luminance of the data signals of each of the pixels and the data signals of each of the adjacent pixels has the similarity when the luminance difference between the data signals of each of the pixels and the data signals of each of the adjacent pixels is within the predetermined range.

20. The driving method according to claim 17, wherein when a relationship between the data signals of the center pixel of each 3*3 pixel array and the data signals of the adjacent pixels of each 3*3 pixel array around the center pixel comprises that the center pixel has connection with both left upper and right lower pixels, or the center pixel has connection with both right upper and left lower pixels, or the center pixel has connection with both right and left pixels, or the center pixel has connection with both upper and lower pixels, and the center pixel has no connection with the remaining pixels, then the driving device correspondingly drives two sub-pixels of the center (x, y) pixel without combining with sub-pixel of the adjacent pixel for color mixing, where x represents a position in row, y represents a position in column, wherein the connection means that the luminance of the data signals of each of the pixels and the data signals of each of the adjacent pixels has the similarity when the luminance difference between the data signals of each of the pixels and the data signals of each of the adjacent pixels is within the predetermined range.

21. The driving method according to claim 17, wherein when a relationship between the data signals of the center pixel of each 3*3 pixel array and the data signals of the adjacent pixels of each 3*3 pixel array around the center pixel comprises that the center pixel has no connection with any pixel around thereof, then the driving device correspondingly drives two sub-pixels of the center (x, y) pixel, one sub-pixel of the (x+1, y) pixel adjacent the (x, y) pixel, and one sub-pixel of the (x−1, y) pixel adjacent the (x, y) pixel for color mixing, where x represents a position in row, y represents a position in column, wherein the connection means that the luminance of the data signals of each of the pixels and the data signals of each of the adjacent pixels has the similarity when the luminance difference between the data signals of each of the pixels and the data signals of each of the adjacent pixels is within the predetermined range.

* * * * *